United States Patent [19]

Jacobsen

[11] Patent Number: 4,688,410

[45] Date of Patent: Aug. 25, 1987

[54] KEY HOLDER

[75] Inventor: Stephen C. Jacobsen, Salt Lake City, Utah

[73] Assignee: Jacobsen Research Corp., Salt Lake City, Utah

[21] Appl. No.: 797,206

[22] Filed: Dec. 20, 1985

Related U.S. Application Data

[62] Division of Ser. No. 473,138, Mar. 7, 1983, Pat. No. 4,571,967.

[51] Int. Cl.[4] ..... A44B 15/00

[52] U.S. Cl. ..... 70/458

[58] Field of Search ..... 70/456–459; 24/3 K, 237

[56] References Cited

U.S. PATENT DOCUMENTS

| | | | |
|---|---|---|---|
| 603,247 | 5/1898 | Becker | 70/458 |
| 1,619,582 | 3/1927 | Long | 70/456 R |
| 2,292,563 | 8/1942 | Imhoff | 70/458 |
| 2,298,304 | 10/1942 | Mitchell | 70/456 R |
| 2,362,280 | 11/1944 | Kollock | 70/458 |
| 2,669,113 | 2/1954 | Gillette | 70/456 R |
| 4,325,273 | 4/1982 | Gibbons | 70/458 X |

*Primary Examiner*—Robert L. Wolfe

*Attorney, Agent, or Firm*—Thorpe, North & Western

[57] ABSTRACT

A key holder includes a generally flat base element whose length is substantially the same as or greater than the length of a conventional automobile or house key. One or more arms are hingedly attached at one end to an edge of the base element to fole in overlying relationship with the element. A key may be coupled to the free end of the arm in such a manner that the key can be folded generally flat against the arm between the arm and the base element. If more than one arm is provided, alternate ones of the arms are attached to one side of the base element and the remaining arms are attached to the other side so that when the arms are folded over the base, they lie in a generally parallel relationship to one another. In an alternative arrangement, keys may be held generally flat against the base element by a series of loops disposed on the element and into which the keys may be inserted. Loops are formed on both sides of the base element so that keys may be held in place on both sides. In still another alternative arrangement, the key holder includes a case having generally parallel top and bottom walls, at least one arm hingedly attached at one end to one side of the case to pivot toward and away from the case, and a coupling element for coupling a key to the free end of the arm in such a way that the key may be folded to a position between the arm and the case to be received between the top and bottom walls when the arm is pivoted toward the case.

2 Claims, 11 Drawing Figures

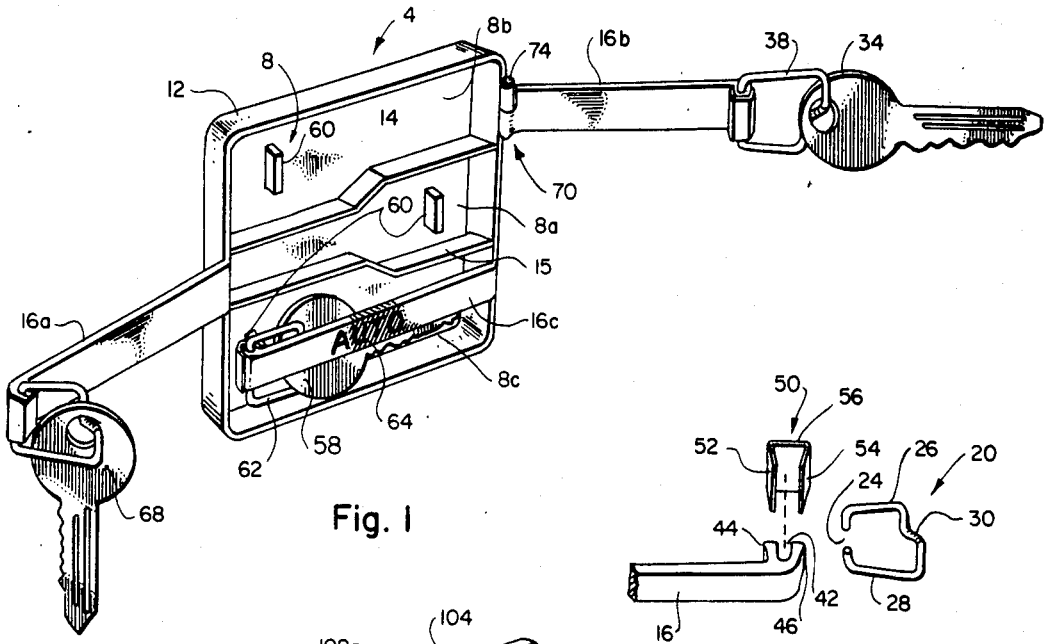
Fig. 1
Fig. 2
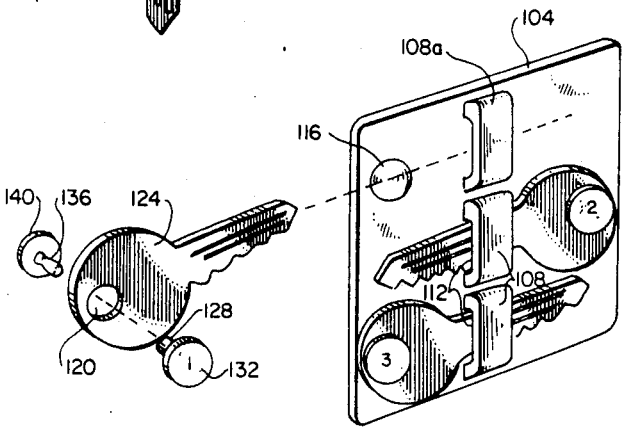
Fig. 3
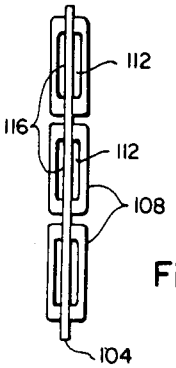
Fig. 4
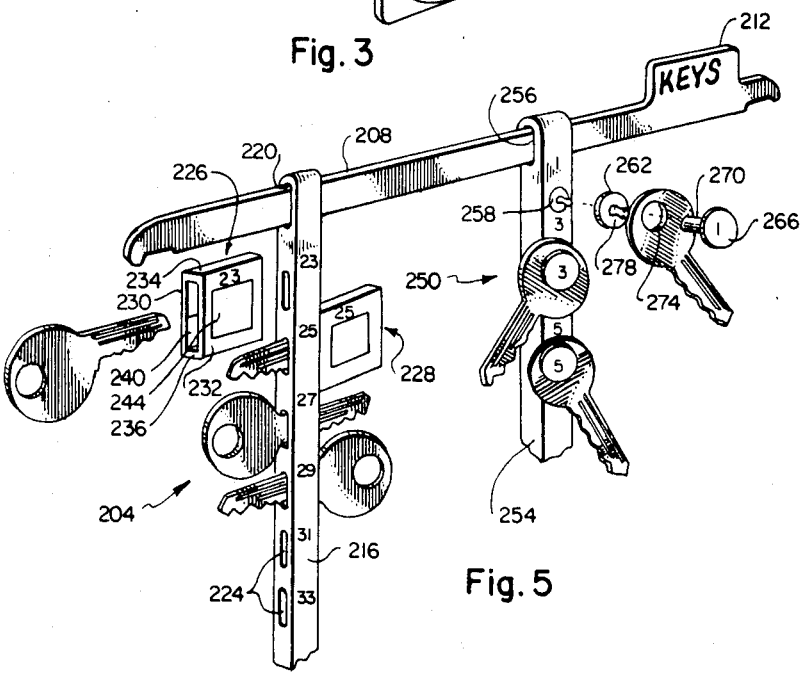
Fig. 5

KEY HOLDER

This application is a division of application Ser. No. 06/473,138, filed 3/7/83 and now U.S. Pat. No. 4,571,967.

BACKGROUND OF THE INVENTION

This invention relates to a simple and compact structure for receiving and holding conventional keys for automobiles, homes, and the like.

The well known "key ring" is the most commonly used device for retaining keys. Although the typical key ring serves to hold a number of keys together and is relatively easy to use in that keys can be readily placed upon or removed from the ring, it is also quite bulky and, if a number of keys are placed on the ring, inconvenient and uncomfortable for placement in a person's pocket for example. Most other presently used devices for retaining keys suffer from this same drawback.

SUMMARY OF THE INVENTION

It is an object of the invention to provide a simple, compact and easy to use structure for holding keys.

It is another object of the invention to provide such a structure capable of retaining keys together in a generally thin, planar profile.

It is also an object of the invention to provide a structure whereby keys may be held in a generally compact and nested relationship.

It is a further object of the invention to provide such a structure which is easy to manufacture.

It is an additional object of the invention, in accordance with one aspect thereof, to provide a structure for holding keys in such a way that they can be readily identified and positioned for use.

The above and other objects of the invention are realized in a specific illustrative embodiment of a key holder which includes a base having at least one generally flat surface whose longest dimension is substantially the same as or greater than the length of the keys to be held, and a securing device for holding a key generally flat with the flat surface of the base. The securing device may take the form of an arm hingedly attached at one end to an edge of the base so as to fold in overlying relationship with the flat surface. Then, a coupling element would couple a key to the free end of the arm so that the key could be folded generally flat against the arm between the arm and the flat surface. Alternatively, keys may be held against the flat surface by one or more loops formed on the surface into which keys may be inserted. Still another embodiment of the securing device includes an arm which is hingedly attached to swing laterally from one edge of the base. A key would be attached to the free end of the arm and would lie in a generally side-by-side relationship with the arm against the flat surface of the base. These arrangements hold the keys in a plane which is generally parallel to the plane of the base so that the keys and base present a generally flat, planar profile.

In another embodiment of the invention, a specially formed ring provides for holding a plurality of keys together in a compact array. The ring includes a semicircular loop, a pair of legs extending perpendicularly from respective ends of the loop and generally parallel to one another, and a connecting brace joined at its ends to the ends of the legs. Keys may be placed on the ring, with the legs of the ring positioned in the openings of the keys, so that the keys lie in parallel with one another and with the plane of the semicircular loop.

Still another embodiment of the invention includes an elongate beam having structure for attaching one end of the beam to a support so that the beam depends downwardly therefrom, and a plurality of devices provided on the beam for securing keys on the beam along the length thereof.

BRIEF DESCRIPTION OF THE DRAWINGS

The above and other objects, features and advantages of the invention will become apparent from a consideration of the following detailed description presented in connection with the accompanying drawings in which:

FIG. 1 is a perspective view of one embodiment of a key holder made in accordance with the principles of the present invention, with keys shown in place on the key holder;

FIG. 2 is a fragmented, exploded view of structure for mounting keys on the key holder of FIG. 1;

FIG. 3 is a perspective, partially exploded view of another embodiment of the key holder of the present invention;

FIG. 4 is an edge view of the key holder of FIG. 3;

FIG. 5 is a perspective, partially exploded view of an additional embodiment of the key holder of the present invention, especially suitable for storing keys;

DETAILED DESCRIPTION

Figure 6B:
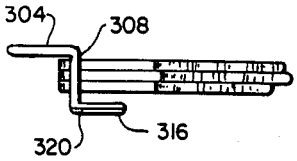
FIGS. 6A through 6C show, respectively, a perspective view, a side view and a top plan view of a key holder ring made in accordance with the present invention.

Referring to FIGS. 1 and 2, there is shown one specific embodiment of the present invention which includes a base 4 having a generally flat, planar floor 8, side walls 12 extending upwardly from the edges of the floor and a pair of divider walls 14 and 15 extending upwardly from the floor and each spaced about an equal distance from opposite side walls and from each other. The base 4 is generally rectangular, although this is not a requirement.

Hingedly attached to the tops of the side walls 12 on opposite sides of the base 4 are a plurality of arms **16*a*, 16*b* and 16*c*. These arms may be folded to generally overlie the floor 8 (as shown for arms 16*c*) so that the arms are arranged generally parallel to one another and to the divider walls 14 and 15. As shown in FIG. 1, two of the arms 16*b* and 16*c* are attached to one side of the base 4 whereas the third arm 16*a*** is attached to the other side. If more than three arms were provided, then advantageously alternate ones of the arms would be attached to one side of the base with remaining arms being attached to the other side.

The keys are coupled to the free ends of the arms in such a manner that the keys may be folded generally flat against the arm to which it is coupled between that arm and the floor 4. This is made possible by the coupling structure shown in FIG. 2. This structure includes a ring element 20 formed with a break 24 to allow placement of keys on the ring element. Those portions 26 and 28 of the ring element which are immediate on either side of the break 24 define a plane, and another portion 30 of the ring element extends generally perpendicularly to this plane. Provision of the portion or section 30 allows for placing a key on the ring element so that the plane of the key is generally parallel to the plane defined by portions 26 and 28. This is best seen for a key 34 mounted on a ring 38 attached to the end of arm 16*b* of FIG. 1.

In order to attach the ring 20 to the end of an arm 16 (FIG. 2) the end of the arm is formed with a channel 42 facing laterally of the arm for receiving the ring element. Exterior surfaces 44 and 46 which lie generally parallel with the channel 42 are formed to flare outwardly from the channel to present a Y shape. The ring element 20 is secured on the end of the arm 16 by placing the ring element, and specifically that portion of the ring element having the break 24, in the channel 42, pivoting the ring element back to lie against the arm 16, and then slipping a clip 50 over the end of the arm. The clip 50 has a generally U-shaped cross section having side walls 52 and 54 and a bottom wall 56. The clip 50 is made of a resilient material, with the upper edges of the side walls 52 and 54 biased inwardly. The interior dimensions of the clip 50 are substantially the same as the exterior dimensions of the end of the arm 16 so that the clip may be slid over the end of the arm to grip the arm and retain the ring element 20 in the channel 42. Installed ring elements and clips are shown in FIG. 1.

Arm 16*c* is shown in overlying relationship with the floor 8 with a key 58 positioned generally flat against the arm between the arm and the floor. A ring element 62 is pivoted to lie generally flat against the arm, with the key 58 being mounted thereon to extend longitudinally along the length of the arm 16*c*. If the other arms 16*a* and 16*b* were appropriately folded onto the base 4, the keys mounted on the arms would nest with one another and with key 58 in a convenient and compact relationship in the base 4. Divider walls 14 and 15 maintain keys apart to prevent them from becoming mixed or tangled.

The arms 16 are held in folded position on the base by latching elements 60 which extend outwardly from the floor 8 and are positioned to contact and frictionally hold respective ends of the arms. In particular, the bottom, inside surface of the end of each arm is shaped to conform and hold to the side of a respective one of the elements 60, as shown in FIG. 1. Of course, a variety of latching mechanisms could be employed to hold the arms in place on the base 4.

As a convenience for easily selecting the appropriate key for a given use, indicia may be inscribed or otherwise placed on the outer surface of the arms to indicate the type of key mounted on a particular arm. Thus, the word "auto" 64 is inscribed on the arm 16*c* to indicate that the key 58 is for use with an automobile.

It will be apparent from the above discussion that additional arms could be provided with the structure of FIG. 1 to fold in overlying relationship on the other side of the floor 8 which is not shown. Provision of such additional arms would double the key holding capacity of the key holder of FIG. 1, while not substantially increasing the bulk or cost of the key holder. Alternatively, arm 16*a* could be arranged to fold in overlying relationship on the other side of the floor 8, and middle section 8*a* could be recessed (when viewed from the other side) to receive the key 68. Two side sections 8*b* and 8*c* of the base 4 would then appear recessed when viewed from the perspective of FIG. 1. Since all sections 8*a*, 8*b* and 8*c* of the base against which keys were to be placed would be recessed to prevent sideways movement of the keys, there would be no need for divider walls 14 and 15.

Advantageously, the arms 16*a*, 16*b* and 16*c* are formed integrally with the base 4 of a plastic material such as polypropylene. Alternatively, the arms could be attached to the base 4 by conventional hinges such as hinge 70 (FIG. 1) having pins, such as pin 74, which when removed would release the arms for detachment from the base.

Although specific coupling structure for coupling keys to the arms has been shown and described, it will be apparent that other types of structure could also be used. For example flexible tethers could be used to couple the keys to the ends of the arms and such tethers would allow for positioning the keys flat against the arms and the floor 8. Also, the free end of an arm could be molded with a bore (in place of channel 42 so that the clip 50 would not be needed), and the ring 20 made of a resilient material to enable the ends of the ring to be spread apart, for fitting into each end of the bore, and then to spring back into position in the bore. A variety of other types of coupling structure could also be provided.

FIGS. 3 and 4 show an alternative embodiment of the invention to include a generally rectangular, flat base 104. Formed on each side of the base, generally in line midway between opposite edges of the base are a plurality of loops or bridges 108. The loops 108 are formed to define channels 112 for receiving the shanks of keys. The channels 112 are dimensioned to receive the shank of a key but to prevent entry and movement therethrough of the enlarged portion of the key, as shown in FIG. 3. The loops 108 are spaced apart in a line on each side of the base 104 so that when keys are inserted in the channels, with one key being inserted in one side of a loop, the next key being inserted in the other side of the loop, etc., the keys are held in place flat against the base 104 in a type of nested relationship.

Advantageously, the base 104 and loops 108 are integrally formed of a resilient material so that the loops will give slightly as a key is inserted thereinto and then will hold the key in place. To further assist in holding each key in place, a depression 116 is provided in the base 104 to be coincident with the opening 120 of a corresponding key 124 when the key is inserted into loop 108*a*. An elongate female portion 128 of a snap is attached to a button 132 on which may be inscribed indicium for identifying the key 124. The female portion 124 is inserted through the opening 120 of the key, and a male portion 136 of the snap is snapped thereonto. The male portion 136 includes a rearwardly extending protrusion 140 which registers into the depression 116 as the key 124 is inserted into the loop 108*a*, to assist in holding the key in place.

FIG. 5 shows a key holder especially adapted for use with file cabinet storage and in particular with filing systems marketed under the name "Pentaflex". Key holders 204 and 250 are used in conjunction with a conventional horizontal brace 208 which may be placed on a support frame in a filing drawer or cabinet. Mounted on the brace 208 to extend upwardly therefrom is a tab 212 on which is inscribed the word "keys". This feature facilitates the finding of the brace 208 and thus the keys stored thereon when the brace and keys are placed in a filing cabinet.

The key holder 204 consists of an elongate beam 216 made, for example, of polypropylene. An opening 220 is formed in the upper end of the beam 216 for receiving the brace 208 as shown. Thus, when the brace is put in position on a frame, the beam 216 will depend downwardly from the brace. A plurality of slots 224 are formed in and spaced along the beam 216 to extend from one side of the beam through to the other side thereof. The slots 224 are formed of a size to receive the shank of the types of keys to be held, but to prevent entry of the enlarged portion of such keys. Advantageously, the slots are spaced apart so that alternate keys are inserted into the slots from one side, and the remaining keys are inserted into the slots from the other side. In this fashion, the keys can be held in place in a nesting relationship and thus in a more compact fashion.

Jackets 226 and 228 may be provided for placement on the keys to identify the keys and the slots 224 into which the various keys are to be placed. Each jacket is formed with two side walls 230 and 232, a top wall 234 and a bottom wall 236 which are arranged to define a hollow into which a key may be inserted. A key is inserted through opening 240 into the jacket so that the shank of the key extends through and out a smaller opening on the other side of the jacket. An area 244 is provided on the side of each jacket on which may be written information identifying the key contained in the jacket. Other indicia may also be provided, such as the numeral "23" shown, to match the jacket and corresponding key with a slot, identified by the same indicia, into which the key is to be placed for storage.

Key holder 250 is an alternative embodiment for storing keys in a file cabinet. This embodiment also includes an elongate beam 254, with an opening 256 at the top for receiving the brace 208. Mounted on one side of the beam 254 and spaced therealong are a plurality of male portions 258 of snaps. Corresponding female portions 262 of the snaps are provided for use with caps 266 to hold the keys in place on the beam 254. Each cap includes a tubular section 270 which fits through a key opening 274 and onto a nipple 278 of the female portion 262 of the snap. The female portion 262 of the snap may then be snapped into place on the male portion 258 to hold the key on the beam 254. Indicia may be placed on the caps 266 to identify the location on the beam 254 where the corresponding key is to be placed.

Of course, a plurality of key holders similar to holders 204 and 254 could be positioned on the brace 208 and spaced apart a distance sufficient to allow easy access to the keys and allow insertion and removal of keys from the key holders.

Figure 6A:
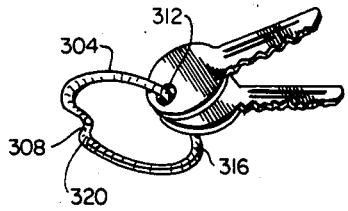
Figure 6C:
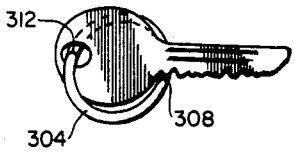

FIGS. 6A, 6B and 6C show a novel key ring construction for holding a plurality of keys in a compact configuration. The key ring includes a first semicircular section 304 made of metal, hard plastic or other fairly rigid material. Two legs 308 and 312 are joined at their ends to respective ends of the first section 304 to extend in a direction generally parallel to one another and generally perpendicular to the plane of the section 304. The other ends of the legs 308 and 312 are joined to the ends of a second semicircular section 316 whose plane is generally parallel with, but spaced from the plane of the first section and which extends in a direction opposite that of the first semicircular section 304. The section 316 is split so that one portion overlies the other and so that the lower portion terminates in a free end 320, and the upper portion terminates in a free end on the other side of section 316. This allows spreading the upper and lower portions of section 316 to enable placement of keys on the ring in the conventional manner.

Keys placed on the ring of FIGS. 6A through 6C may be moved so that the key openings circumscribe one of the legs, such as leg 312, and thus lie generally parallel to one another and to the planes of the semicircular sections 304 and 316 (best seen in FIG. 6B). This configuration can be made even more compact by pivoting the ring to the position shown in FIG. 6C where the leg 308 contacts or nearly contacts the shanks of the keys. As can be seen, there is no bulky section of the ring protruding outwardly from the keys to cause discomfort or inconvenience. Also, by providing at least one semicircular section, the keys may be freely moved apart from one another onto the section for use. One of the semicircular sections could be replaced with simply a straight brace joining corresponding ends of the legs 308 and 312, leaving the other section to move keys onto.

Figure 7:
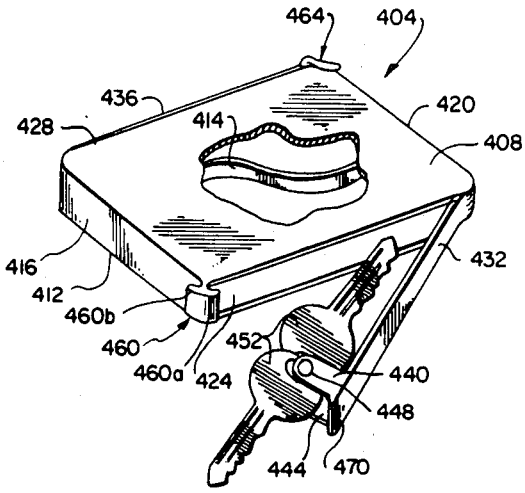
FIG. 7 is a perspective view of still another embodiment of the key holder of the present invention.

Another embodiment of the invention is shown in perspective view in FIG. 7. This embodiment includes a case 404 composed of a top wall 408, a bottom wall 412, a divider wall 414, and two side walls 416 and 420. The case 404 thus has a front opening 424 and a rear opening 428 to provide for "side-loading" of keys into the case as will be further described hereafter.

Hingedly attached at the ends to opposite corners of the case 404 are a pair of arms 432 and 436. The other end of each arm includes structure for holding keys consisting of a pair of ears 440 and 444 which extend one above the other laterally of the arm toward the case 404, and a pin 448 which is placed in aligned openings in the ears and through openings in keys 452 to secure the keys on the arm. Since the pin 448 is spaced from the arm 432 and extends vertically with respect to the horizontally positioned arm, keys 452 will pivot about the pin generally in the same plane as that occupied by the case 404, as shown. Keys may be placed on or removed from the holder of FIG. 7 by simply removing the appropriate pin, properly positioning or removing the key, and then replacing the pin.

When none of the keys on the holder of FIG. 7 are in use, the keys are pivoted toward the inside surface of the arms 432 and 436 so as to lie generally parallel therewith, and the arms are folded into the case 404 so that the keys are received into respective openings 424 and 428. The keys on each arm are maintained apart by the divider wall 414. Tab latches 460 and 464 are formed on opposite corners of the case 404 for latching and holding in the folded position arms 432 and 436 respectively. Each tab latch includes a hook portion, such as hook portion **460*a*, and a lever portion, such as lever portion 460*b*, so that when the lever portion is pressed the hook portion pivots away from the case 404 to release the corresponding arm. The free end of each arm includes a lip, such as lip 470, which engages a corresponding hook portion, such as hook portion 460*a*, when the arm is folded into the case 404, to thereby force the hook portion to pivot outwardly until the lip is grasped or caught by the hook portion (as shown for arm 436 of FIG. 7**). The tab latch thus holds the arm in the folded position until the lever portion of the latch is depressed to release the arm.

Advantageously, the arms 432 and 436, and tab latches 460 and 464 ar formed integrally with the case 404 of a plastic material such as polypropylene. Alternatively, the arms 432 and 436 could be constructed separately and then joined by hinges, such as shown for the FIG. 1 embodiment, to the case 404. Of course, there are a variety of ways of securing keys on the arms and of latching the arms in the folded position, besides those shown and described for FIG. 7.

Figure 8A:
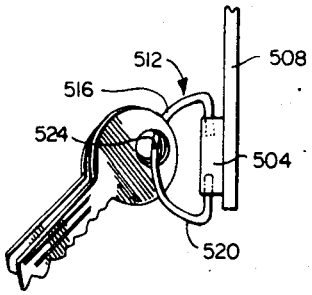
FIGS. 8A and 8B show, respectively, a top plan view and a back side view of an alternative embodiment for coupling keys to the arms 432 and 436 of FIG. 7.
Figure 8B:
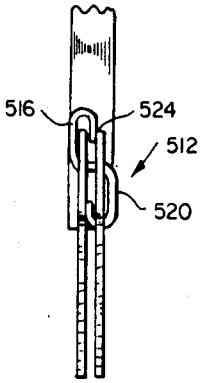

FIGS. 8A and 8B show respectively a top plan view and a side view of an alternative structure for coupling keys to the arms 432 and 436 of FIG. 7. This structure includes a bore defining boss 504 formed on the end of arm 508. The bore (not shown) extends through the boss 504 generally parallel to the arm 508. A ring 512 is formed with a break or opening to allow spreading the ends thereof for placement into the ends of the bore. The ring 512 is also formed with two quarter-cylinder sections 516 and 520 whose planes are generally parallel but spaced apart. One end of each quarter-circular section is bent to fit into a respective end of the bore formed in boss 504. The other end of each section is joined to a different end of a cross leg 524 which is disposed generally perpendicularly to the planes of the quarter-circular sections 516 and 520. With the ring 512, keys can be positioned so that their openings circumscribe the cross leg 524 in which event the keys may be pivoted back along the inside of the arm for folding into the case 404 (FIG. 7).

The key holder arrangements described all provide for storage of keys in a convenient and compact fashion. In each arrangement, the keys are positioned in the same or substantially parallel planes. In a number of the embodiments, alternate ones of the keys face in one direction and the remaining keys are positioned to face in the other direction to allow closer grouping of the keys.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A key holder ring comprising a first generally semicircular section defining a plane, a pair of legs, each joined at one end to a respective end of the semicircular section to extend in a direction generally parallel to one another and generally perpendicular to the plane of the first section, and a second generally semicircular section whose ends are joined to the other ends of the legs to lie in a plane which is generally parallel with but spaced from the plane of the first section and which extends in a direction generally opposite that in which the first section extends, said second section being split into two portions so that one portion overlies the other and so that one portion terminates in a free end near one of the pair of legs and the other portion terminates in a free end near the other one of the pair of legs, said portions being spreadable apart to allow sliding over either of the portions, of keys having openings therein of a sufficient size to receive either semicircular section and either leg.

2. A key holder as in claim 1 wherein the legs are of sufficient length so that a plurality of keys may be placed with the key openings circumscribing the legs.

* * * * *